US006190151B1

(12) United States Patent
Hunt

(10) Patent No.: US 6,190,151 B1
(45) Date of Patent: Feb. 20, 2001

(54) APPARATUS FOR MOLDING THREE-DIMENSIONAL OBJECTS

(75) Inventor: John F. Hunt, Madison, WI (US)

(73) Assignee: The United States of America as represented by the Secretary of Agriculture, Washington, DC (US)

( * ) Notice: Under 35 U.S.C. 154(b), the term of this patent shall be extended for 0 days.

(21) Appl. No.: 09/112,872

(22) Filed: Jul. 9, 1998

(51) Int. Cl.[7] ..... B28B 1/52

(52) U.S. Cl. ..... 425/80.1; 425/85; 425/405.1; 264/87; 162/227

(58) Field of Search ..... 425/84, 85, 405.1, 425/470, 80.1; 264/87, 86; 162/223, 226, 227, 296, 382

(56) References Cited

U.S. PATENT DOCUMENTS

| | | | | |
|---|---|---|---|---|
| 1,002,132 | | 8/1911 | Brown | 428/166 |
| 3,166,467 | | 1/1965 | Reifers et al. | 162/223 |
| 3,255,062 | | 6/1966 | Wilkins | 156/79 |
| 3,290,421 | | 12/1966 | Miller, Jr. | 264/219 |
| 3,354,248 | | 11/1967 | Haas et al. | 264/119 |
| 3,449,207 | | 6/1969 | Modersohn et al. | 264/119 |
| 3,857,752 | | 12/1974 | McCoy | 162/411 |
| 4,162,877 | | 7/1979 | Nyberg | 425/84 |
| 4,388,263 | | 6/1983 | Prunty | 264/257 |
| 4,528,239 | * | 7/1985 | Trokhan | 428/247 |
| 4,702,870 | | 10/1987 | Setterholm et al. | 264/87 |
| 4,753,713 | | 6/1988 | Gunderson | 162/383 |
| 4,812,283 | | 3/1989 | Farley et al. | 264/518 |
| 4,960,553 | * | 10/1999 | DeBruine et al. | 264/113 |
| 5,039,465 | | 8/1991 | Freeman et al. | 264/86 |
| 5,106,668 | | 4/1992 | Turner et al. | 428/116 |
| 5,151,312 | | 9/1992 | Boeri | 428/156 |
| 5,198,167 | | 3/1993 | Ohta et al. | 264/86 |
| 5,198,236 | | 3/1993 | Gunderson et al. | 425/80.1 |
| 5,277,854 | | 1/1994 | Hunt | 264/86 |
| 5,314,654 | | 5/1994 | Gunderson et al. | 264/517 |
| 5,356,578 | * | 10/1994 | Isomura et al. | 264/42 |
| 5,876,835 | * | 3/1999 | Noble et al. | 428/156 |

* cited by examiner

*Primary Examiner*—Harold Pyon
*Assistant Examiner*—Donald Heckenberg
(74) *Attorney, Agent, or Firm*—Janet I. Stockhausen; M. Howard Silverstein; John D. Fado

(57) ABSTRACT

A method of making a three-dimensional object from fibers includes attaching a mold made at least in part of elastomeric material to a porous support. The mold comprises a first mold member defining at least one channel in fluid communication with the porous support. Each channel has within it at least one second mold member. A mixture of fibers and fluid carrier is poured onto the mold. Thereafter, a pressure differential is created across the mold to create a flow of the mixture toward the porous support via the second mold members. This flow causes the fluid carrier to pass through the porous support, thus depositing the fibers within the recessed parts of the second mold members in the mold. Thereafter, the mold is compressed sufficiently to deform the mold and to provide uniform, normal pressure to the fibers which have been deposited in the second mold members.

42 Claims, 8 Drawing Sheets

FIG. 1
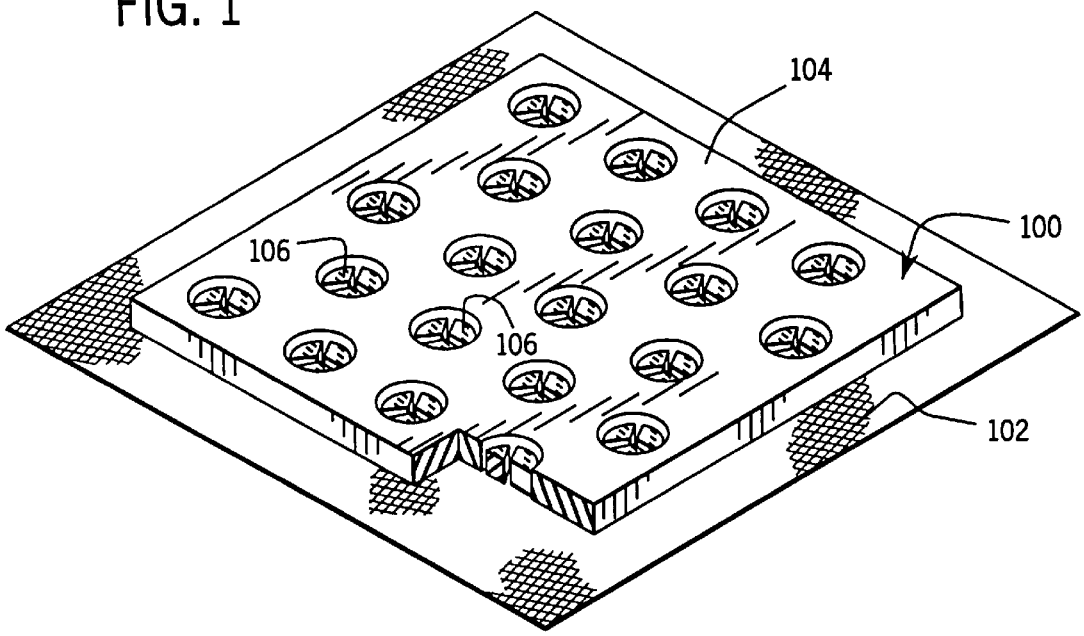
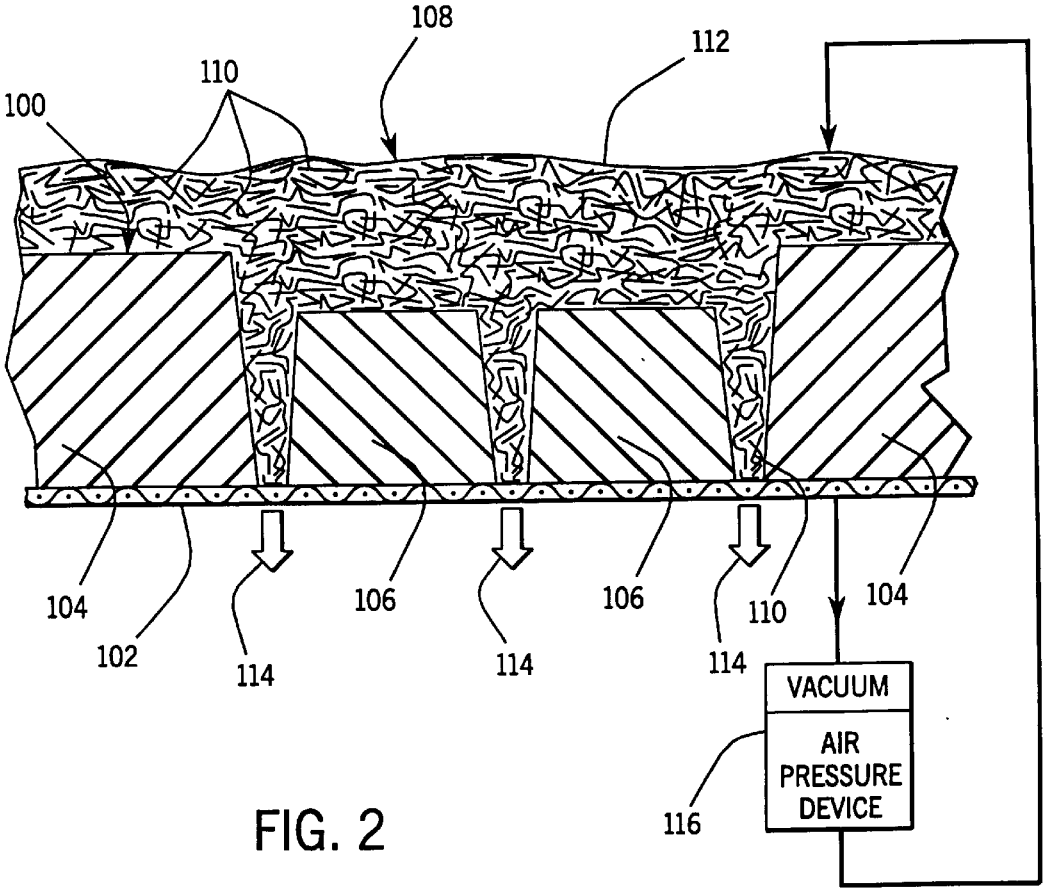
FIG. 2

APPARATUS FOR MOLDING THREE-DIMENSIONAL OBJECTS

TECHNICAL FIELD

The present invention relates generally to the production of three-dimensional objects from fibers, and, more specifically, the present invention relates to a method and apparatus for compressing fibers in a mold made at least in part of an elastomeric material to create a three-dimensional object.

BACKGROUND OF THE INVENTION

Generally, fiber structures of the kind used for cushioning and packaging (for example, pulp packaging, peanuts, egg crates and the like) are formed from cellulose fibers using a wet forming process. The product is formed on a solid, rigid mold that is covered with a screen material on all of its surfaces. The strength of the resultant structure is due to entanglement of the fibers and hydrogen bonding. Some strength-enhancing chemical or resin may also be added.

The strength resulting from fiber entanglement depends upon the type and length of the fibers used. Bonding of cellulosic fibers depends on fiber-to-fiber contact, which is increased with increased compression of the fiber mat. Current industry use of compression of pulp-molded articles ranges from no compression to compression by mating male and female rigid molds that have close tolerances for higher consolidation of the fibers.

If the structure has any three-dimensional parts, the sides of the structure must have a draft angle, so that the compression force of the mating molds has a component force on the sides of the mold normal to the structure being formed. If the sides of the mold are substantially vertical, the mating part is not able to apply a compression force component normal to sides of the structure.

The structural performance of a pulp-molded article can be enhanced by fiber addition or by increased bonding. Increased bonding may allow for a reduction of fiber content for a given performance need. U.S. Pat. No. 4,702,870, issued to Setterholm et al. for a "Method and Apparatus for Forming Three Dimensional Structural Components from Wood Fiber" and U.S. Pat. No. 5,277,584, issued to Hunt for "Methods and Apparatus for Making Grids from Fibers" illustrate several methods and devices for forming products from the materials herein addressed.

It is an object of the invention to provide a method and apparatus for making three-dimensional structures from fibers for various structural uses.

It is another object of the invention to provide a method and apparatus for making three-dimensional structures from fibers which utilizes compressive forces normal to the surfaces of the object being formed as a result of the composition of the mold.

It is still another object of the invention to provide a method and apparatus for molding three-dimensional objects from fibers which permits the fabrication of such objects in a wide variety of structural configurations.

It is still another object of the invention to provide a method and apparatus for manufacturing three-dimensional objects from fibers where the objects consist of a plurality of interconnected ribs without integral surfaces covering the ribs.

It is a further object of the invention to provide three-dimensional objects manufactured from fibers where the objects consist of a plurality of interconnected ribs without integral surfaces covering the ribs.

It is a still further object of the invention to provide a method and apparatus for making a three-dimensional object from fibers permitting the cost effective use of both cellulosic and non-cellulosic fibers to create such three-dimensional objects.

DISCLOSURE OF THE INVENTION

These and other objects of the present invention are accomplished as explained in the detailed description of the embodiments of the invention in connection with the Figures.

Generally, however, the objects of the invention are accomplished in a method of making a three-dimensional object from fibers which includes attaching a mold made at least in part of elastomeric material to a porous support. The mold comprises a first mold member defining at least one channel in fluid communication with the porous support. Each channel has within it a second mold member structure. A mixture of fibers and fluid carrier is poured onto the mold. Thereafter, a pressure differential is created across the mold to create a flow of the mixture toward the porous support via the channels containing the second mold members. This flow causes the fluid carrier to pass through the porous support, thus depositing the fibers within the recessed portions and generally across the top of the second mold members in the mold. Thereafter, the mold is compressed sufficiently to deform the mold and to provide substantially uniform pressure to the fibers which have been deposited in and on top of the second mold members. In a number of the embodiments, the first mold member and second mold members have different relative heights to achieve various structural features in the formed object. Moreover, the mold may be made of different materials to provide a variety of structural features in the formed object. The apparatus of the present invention is the mold described above.

The invention further provides three-dimensional objects manufactured from fibers where the objects consist of honey comb-like structure including a plurality of interconnected ribs without integral surfaces covering the ribs. Additionally, the invention provides such objects where the ribs include integrally-molded flanges to impart strength and other desirable structural characteristics to the objects.

BRIEF DESCRIPTION OF THE DRAWINGS

FIG. 1 is a perspective view of an embodiment of the present invention;

FIG. 2 is a cross-sectional view of the embodiment of FIG. 1 depicting a fiber and fluid carrier mixture poured onto the mold of the invention;

FIG. 19 depicts the embodiment of FIG. 8 wherein

In the Figures, like reference numerals refer to like elements.

DETAILED DESCRIPTION OF THE INVENTION

Figure 3:
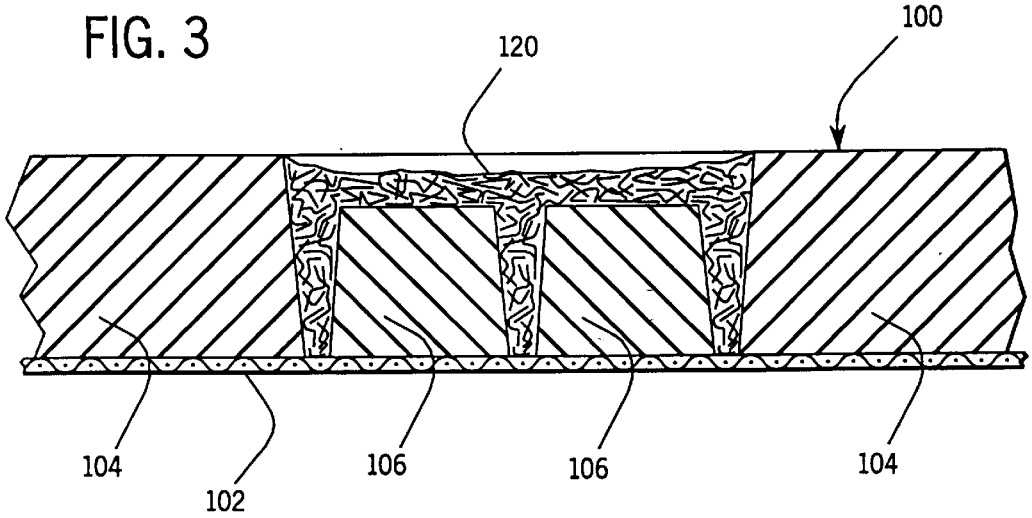
FIG. 3 is a cross-sectional view of the embodiment of FIG. 1 depicting fibers deposited in the recessed portions of the mold formed around the second mold members, after application of a pressure differential across the mold and porous support.

The present invention provides a method and apparatus for molding three-dimensional objects from fibers, as well as certain unique objects produced . The fibers may be cellulosic, non-cellulosic or a combination thereof. Cellulosic fibers, whether virgin or recycled, have natural bonding potential and can be recycled. For some applications, it may be desirable to incorporate synthetic fibers. However, for purposes of illustration, a system for molding three-dimensional objects from cellulosic fibers will be described herein.

An embodiment of the present invention is shown in FIGS. 1–5. In FIG. 1, a mold 100 is mounted on a porous support 102, which can be a metal or composite screen or the like. Preferably mold 100 is made of a low durometer elastomeric material, possessing high deformability and resilience. Silicone rubber has generally desirable elastomeric properties, is readily available, is stable in an aqueous environment, and can withstand relatively high environmental temperatures. Mold 100 is mounted on porous support 102 by suitable means, for example, by an adhesive, a mechanical fastener or by direct molding. Mold 100 is comprised of a first mold member 104 which is depicted as a sheet of elastomeric material such as silicone rubber. The upper surface of first mold member 104 is in fluid communication with porous support 102 via at least one, and preferably a plurality of channels in first mold member 104. That is, fluid poured onto the mold 100 will pass through the channel(s) and into the porous support 102. At least one second mold member 106 will occupy the channel(s) defined in first mold member 104.

Although the invention is described herein generally with reference to a single channel in first mold member 104 containing a single second mold member 106, it will readily be recognized that a plurality of channels can be formed in first mold member 104, each such channel containing at least one second mold member 106, or a second mold member comprising a plurality of separate components, thereby facilitating the formation of a plurality of three-dimensional objects from a single mold 100, and in a single operation. Each of the objects thus-formed can be substantially similar, or a range of objects can be formed from a single mold 100 by appropriate configuration of the first and second mold members 104 and 106. Likewise, the formed objects may be a series of interconnected ribs of a honey comb configuration without integral stressed skins covering the ribs.

As seen more clearly in FIGS. 2 and 3, each second mold member is comprised of recessed structure(s) 106 whose upper surfaces are below the level of the upper surface of the first mold member 104, for reasons which will be explained in greater detail below. The second mold members 106 are generally isolated from one another so that a natural separation of the molded objects is accomplished upon formation.

To initiate the forming process, a mixture 108 of fibers 110 and fluid carrier 112 is poured over the mold. In many embodiments, water acts as the fluid carrier. Water temperatures typically will range from 50° to 140° F. when forming objects with cellulosic fibers. In some applications, it may be desirable to add a resin or adhesive to the fluid carrier. However, such an addition may degrade the recyclability of the fiber objects, and thus should be used judiciously.

As seen in FIG. 2, the fibers 110 are carried within the fluid carrier 112. Once the mixture 108 is poured onto the mold 100, the mixture 108 flows over the mold and toward and into the recessed portions of the mold 100. Fluid 112 begins to pass through the porous support 102 in a direction generally as designated by arrows 114, depositing fibers 110 over the mold faces and within the spaces defined by the first mold member 104 and second mold members 106.

A pressure differential is then created across the mold 100 and the porous support 102, for example by an air pressure control device 116. Preferably the pressure differential is in the range of 1 to 20 inches Hg of vacuum below the mold 100 so as to cause fluid flow through porous support 102. Alternatively, or in conjunction, a head of air pressure above mold 100 can also be used. This pressure differential further enhances the flow of the fluid carrier 112 out of the mold 100 through porous support 102 generally in the direction of arrows 114. This flow of fluid 112 also deposits additional fibers 110 over the mold faces and within the second mold member recesses.

At this point, additional fluid, typically the same as fluid carrier 112, may be sprayed on the mold 100 to "clean" the mold by washing additional fibers into the recessed portions of second mold members 106. As can be seen in FIG. 3, at this stage of the forming process, the three-dimensional object 120 begins to take shape, and the fibers 110 are somewhat condensed and entangled within the recessed spacing of each second mold member 106.

Figure 4:
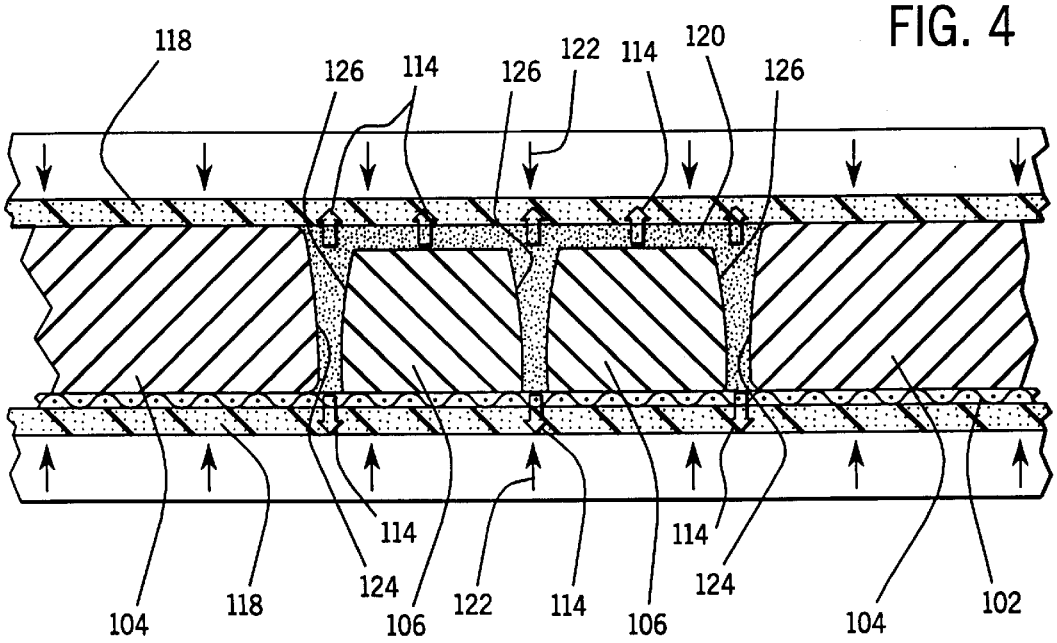
FIG. 4 is a cross-sectional view of the embodiment of FIG. 1 depicting compression of the mold and second mold members by a press and the resulting consolidation of the fibers.

FIG. 4 illustrates the next step in the forming process. A generally flat press 118 is applied to both the top of mold 100 and the bottom of porous support 102. Pressure sufficient to deform the mold 100 to a preselected degree is applied by the press 118 in the direction of arrows 122. In embodiments disclosed herein, this pressure typically is on the order of 25 to 2000 psi, depending on the product being formed.

Preferably, the press 118 is made of porous material, such as is found in a wet felt press or screen material, permitting fluid carrier 112 to flow generally in the direction of arrows 114, as shown in FIG. 4.

Deformation of the first mold member 104 and second mold member 106 permits application of compressive forces generally normal to the surfaces of the object 120 being formed, irrespective of the orientation of those surfaces relative to the press 118.

The three-dimensional object 120 being formed is thus further compressed, and acquires preselected structural features, due to the unique structure and composition of mold 100. As seen in FIG. 4, surface 124 of first mold member 104 has a greater curvature than the sidewalls 126 of second mold member 106. As suggested previously, this effect is due to the difference in height of the first mold member 104 and the second mold member 106. The surface 124 and walls 126 preferably are angularly displaced from vertical, as seen in FIGS. 2 and 3. This angular displacement facilitates removal of the formed object after pressing and contributes to the formation of preselected structural features in the object 120.

In this embodiment, the first mold member 104 is thicker than the second mold member 106. Thus, during pressing, the thicker material of first mold member 104 deforms more than the components of the second mold member 106, causing greater curvature of the first mold member surfaces. Such structural characteristics can also be influenced by appropriate selection of the materials used to form the various components of the mold 100.

The object 120 may also be hot pressed for further processing in mold 100. In some circumstances, fiber-to-fiber bonding can be enhanced when an object is held under pressure while heat is applied. It may also be desirable to remove the object 120 and position it on a second mold similar to molds 104 and 106 yet having tolerances and dimensions closer to the final requirements of the finished object, where the object is held under pressure while heat is applied.

The forming process described herein may be conducted in a batch, semicontinuous or continuous operation. Such processing is well known in the art and can be adapted easily to the present invention by those of ordinary skill in the art. Generally, the mold for batch or semi-continuous operation would have a selected length and width and an array of separate second mold members. The mold for a continuous operation would be a belt or rotary drum having selected dimensions.

Figure 5:
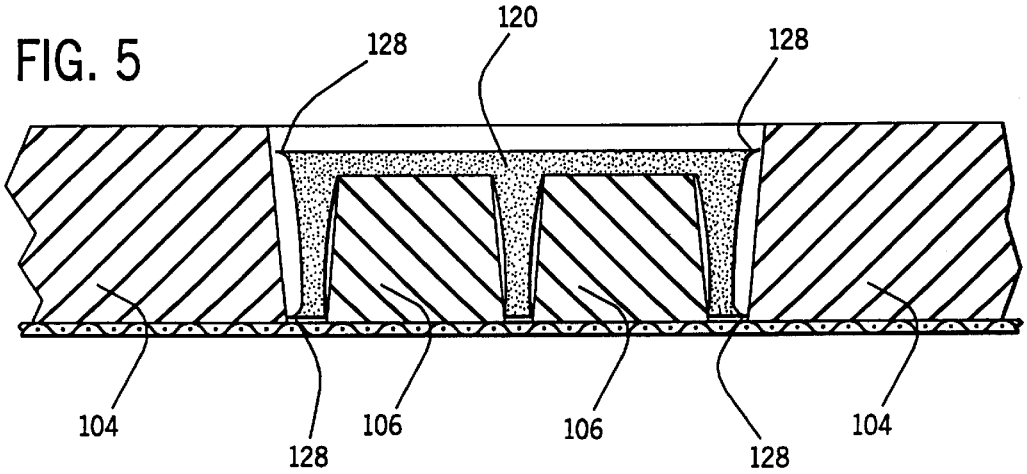
FIG. 5 is a cross-sectional view of the embodiment of FIG. 1 depicting the consolidated formed fiber object in the mold of the present invention.

When pressure is removed from the mold 100, as seen in FIG. 5, the forming surfaces of mold 100 retract from the object 120, facilitating release of the object 120 from the mold 100. Air pressure may be applied under the mold 100 by device 116 to assist in removing the object 120 from the mold 100.

After pressing, the object 120 may be removed for subsequent drying in a convection oven or other drying apparatus. It may also be desirable to remove the object 120 and position it on a second mold similar to molds 104 and 106 yet having tolerances and dimensions closer to the final requirements of the finished object, where the object is held under pressure while heat is applied. Typically, drying temperatures should not exceed 400° F. for cellulosic fibers. For applications using synthetic fibers, other pressing and drying or heating parameters may prove useful and desirable.

As seen in FIG. 5, the present invention permits fabrication of an object 120 possessing features which could not be realized in earlier designs. For example, flanges 128 can be created in the object 120 as a result of the deformation of the elastomeric material in the mold 100. One or more structural ribs with integrally-formed flanges in the top surface can be constructed, including a flange oriented toward the inside of object 120, or, as shown in FIG. 5, a flange to the outside of the object 120. In addition, an "I" beam structure also can be created. It is well known that such "I" beam structures have superior strength-to-weight characteristics, a desirable attribute in certain structural and cushioning applications.

Figure 6:
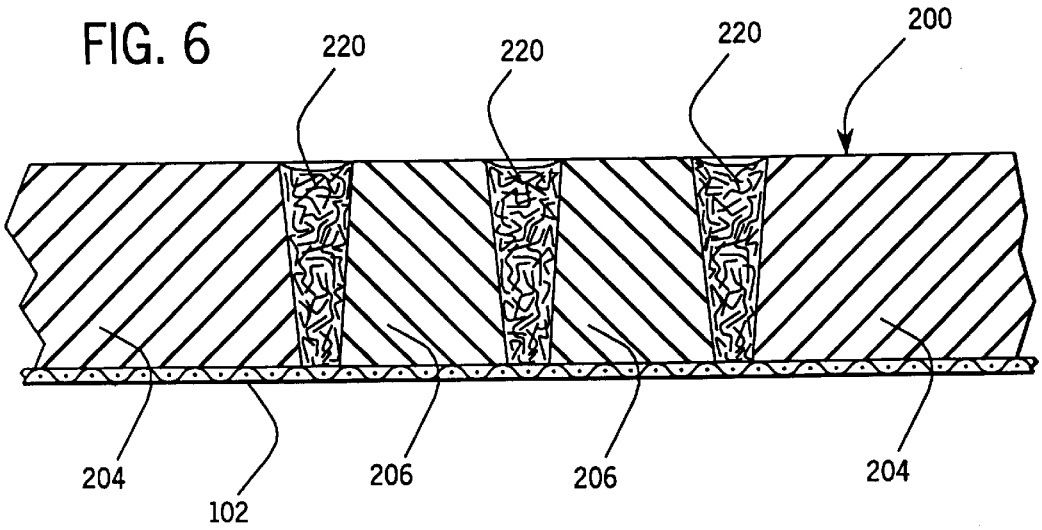
FIG. 6 is a cross-sectional view of a second embodiment of the invention depicting fibers deposited in the recessed portions of the mold formed around the second mold members, after application of a pressure differential across the mold and porous support.
Figure 7:
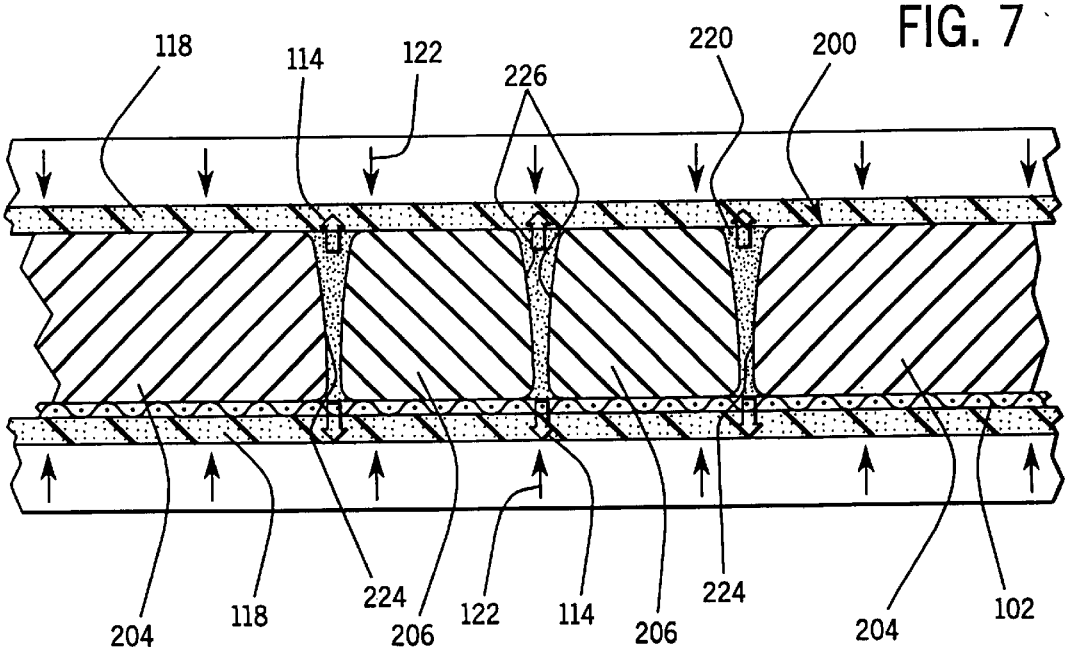
FIG. 7 is a cross-sectional view of the embodiment of FIG. 6 depicting compression of the mold and second mold members by a press and the resulting consolidation of the fibers.
Figure 8:
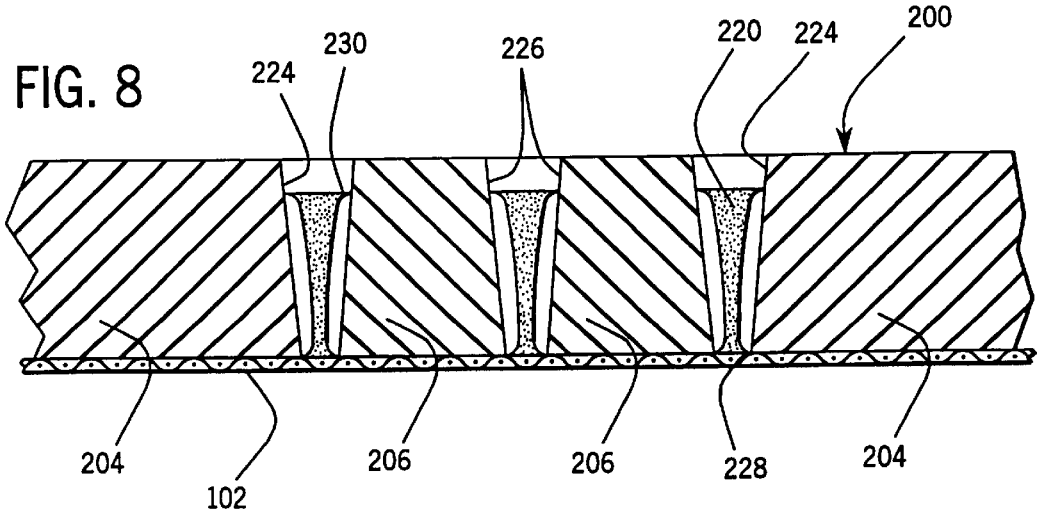
FIG. 8 is a cross-sectional view of the embodiment of FIG. 6 depicting the consolidated formed fiber object in the mold of the invention.

A second embodiment of the present invention is shown in FIGS. 6–8, which illustrate processing steps similar to those shown in FIGS. 3–5. FIG. 6 shows a mold 200 mounted on porous support 102. Mold 200 again is comprised of a first mold member 204 which defines at least one channel in the mold 200 in fluid communication with porous support 102. Second mold member 206 occupies the channel (s) defined in first mold member 204. Again, the surfaces 224 of first mold member 204 and the surfaces 226 of second mold member 206 are angularly displaced from vertical.

As seen more clearly in FIG. 6, each second mold member 206 is comprised of structures whose uppermost surfaces are substantially even with the upper surface of the first mold member 204. The mixture 108 of fibers 110 and fluid carrier 112 is poured over the mold 200, in a manner similar to that shown in FIG. 2, flowing toward and into the channels of the mold 200. The fluid carrier passes through porous support 102, depositing fibers within the spaces only defined by the first mold member 204 and second mold member 206. A pressure differential is created across the mold 200 and porous support 102 by air pressure control device 116.

As seen in FIG. 7, press 118 is applied to the top of mold 200 and the bottom of porous support 102. Mold 200 is deformed, again permitting application of compressive forces substantially normal to the surfaces of the object 220 being formed, irrespective of the orientation of those surfaces relative to the press 118. Preferably, the press 118 is made of porous material, such as is found in a wet felt press or screen material, permitting fluid carrier 112 to flow generally in the direction of arrows 114, as shown in FIG. 4.

The honey comb-like three-dimensional object 220 being formed is further compressed, and acquires preselected structural features due to the unique construction of mold 200. As seen in FIGS. 7 and 8, the angular orientation of the surface 224 and walls 226 of first mold member 204 and second mold member 206, respectively, create honey comb or cellular-like connected ribs with flange structures 228 and 230 having no integrally-molded face surfaces. FIG. 8 illustrates that the upper flanges 230 may differ slightly from the lower flanges 228. These unique objects consisting of ribs with flanges, which can be specially shaped depending upon the desired application or use, will provide a much stronger honey comb structure than any comparable honey comb structure heretofore known in the prior art.

Again, when pressure is removed from the mold 200, the forming surfaces of mold 200 retract from the object 220, permitting easy release of the object 220 from the mold 200. Air pressure may be applied under the mold 200 by device 116 (FIG. 2) to assist in removing the object 220 from the mold 200. As seen in FIG. 8, this alternate embodiment permits fabrication of an object 220 possessing an augmented "I" beam structure, without integral top or bottom surface as previously described and depicted in FIG. 5.

Figure 9:
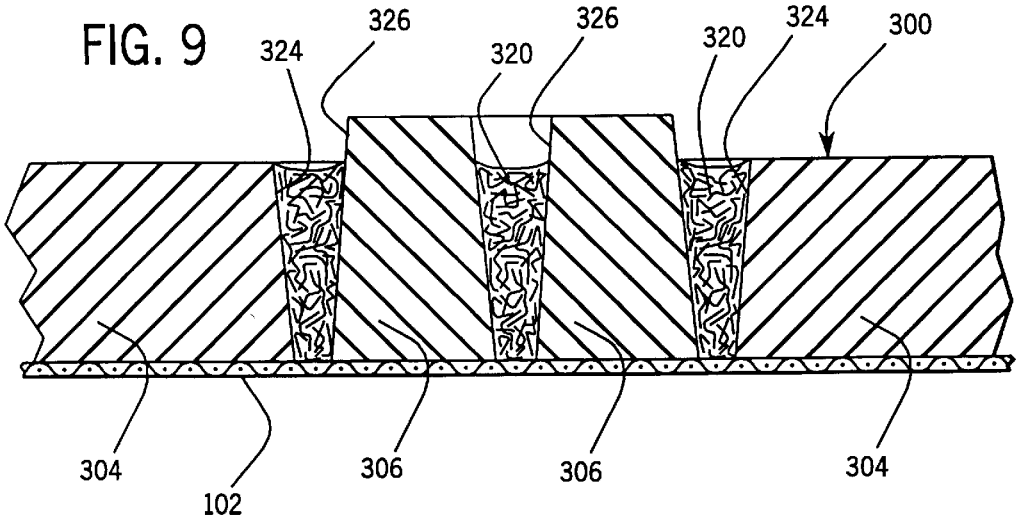
FIG. 9 is a cross-sectional view of a third embodiment of the invention depicting fibers deposited in the recessed portions of the mold formed around the second mold members, after application of a pressure differential across the mold and porous support.
Figure 10:
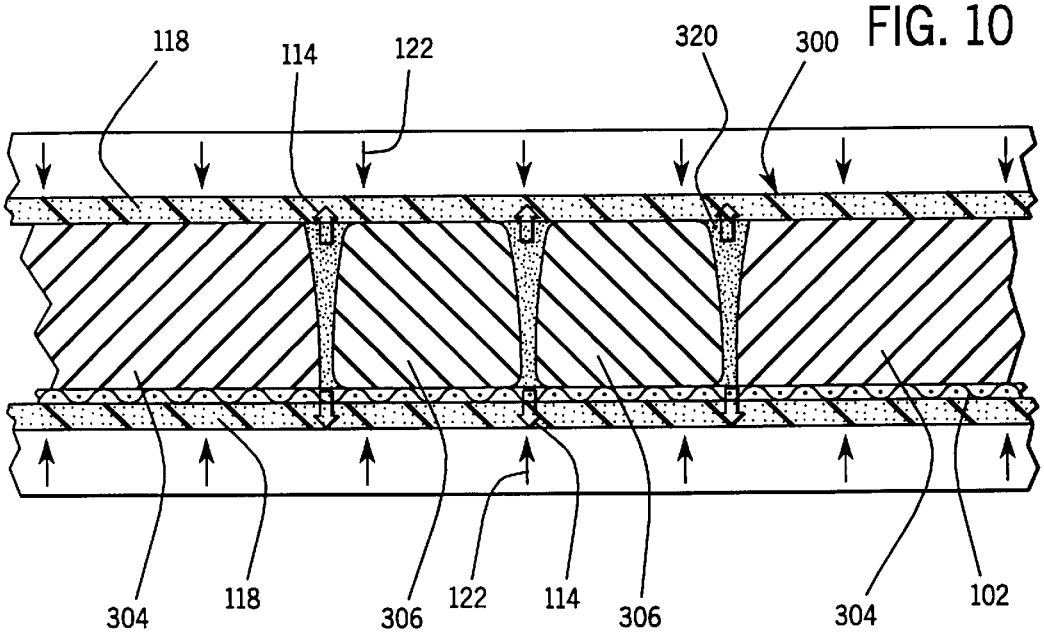
FIG. 10 is a cross-sectional view of the embodiment of FIG. 9 depicting compression of the mold and second mold members by a press and the resulting consolidation of the fibers.
Figure 11:
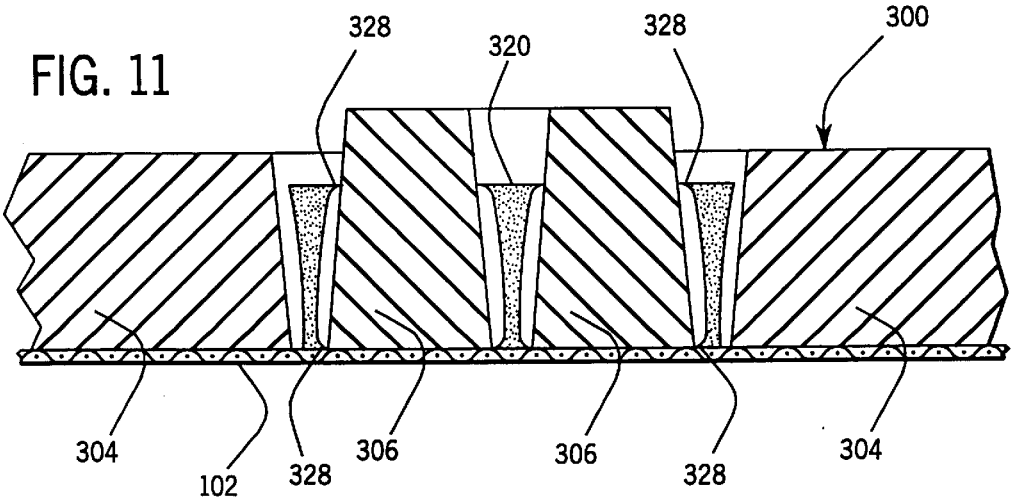
FIG. 11 is a cross-sectional view of the embodiment of FIG. 9 depicting the consolidated final formed fiber object in the mold of the present invention.

A third embodiment of the present invention is shown in FIGS. 9–11, which illustrate processing steps similar to those shown in FIGS. 3–5, but without an integrally-formed top surface. In FIG. 9, a mold 300 is mounted on a porous support 102. In this embodiment, the surfaces 324 of first mold member 304 and the walls 326 of second mold member 306 are again angularly displaced from vertical, however the second mold member structures may also be rounded.

As seen more clearly in FIG. 9, the upper surfaces of second mold member 306 are higher than the upper surface of the first mold member 304. After processing generally in accordance with the description above, the three-dimensional object 320 formed with mold 300 possesses honey comb or cellular-like connected ribs with flanges 328. In this case, the flanges 328 are oriented inwardly. In addition, there is no top or bottom surface; the object consists of the interconnected rib structure.

Figure 12:
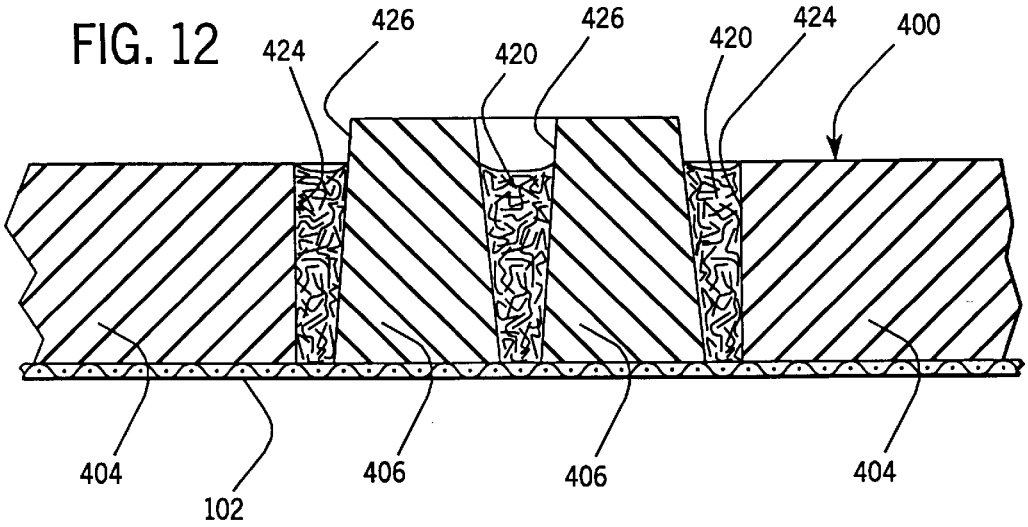
FIG. 12 is a cross-sectional view of a fourth embodiment of the invention depicting fibers deposited in the recessed parts of the mold formed around the second mold members, after application of a pressure differential across the mold and porous support.
Figure 13:
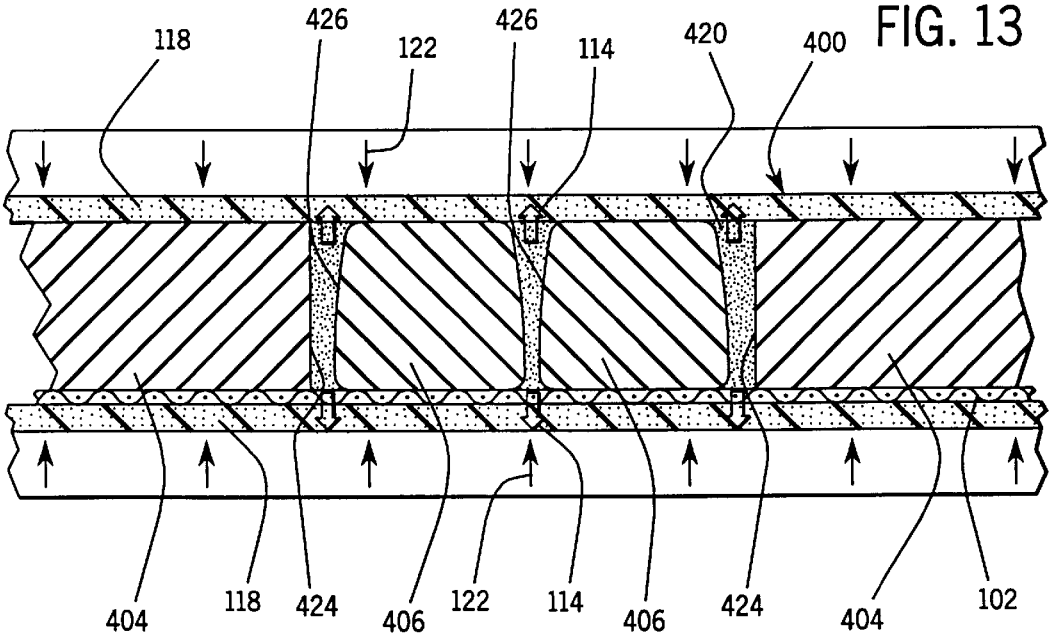
FIG. 13 is a cross-sectional view of the embodiment FIG. 12 depicting compression of the mold and second mold members by a press and the resulting consolidation of the fibers.
Figure 14:
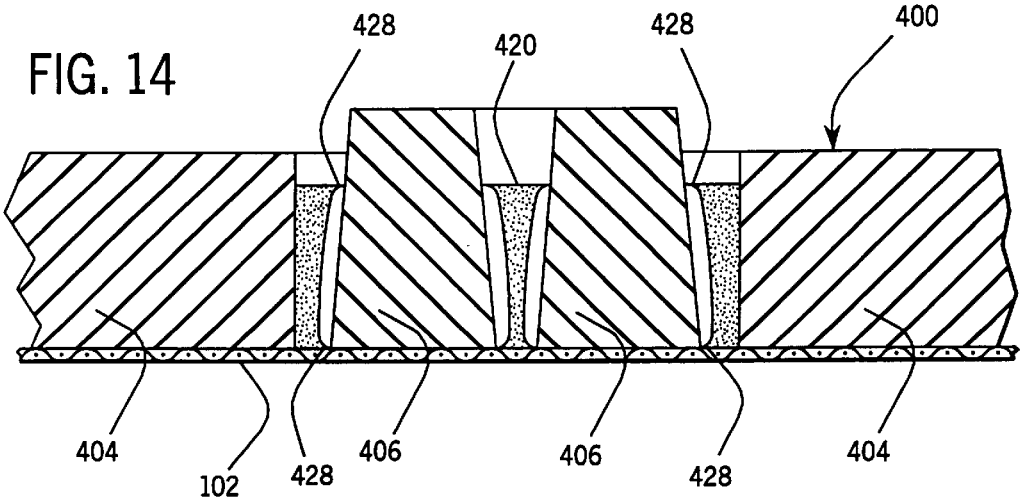
FIG. 14 is a cross-sectional view of the embodiment of FIG. 12 depicting the consolidated formed fiber object in the mold of the invention.

A fourth embodiment of the present invention is shown in FIGS. 12–14, which again illustrate processing steps similar to those shown in FIGS. 3–5, except that there is no integrally-formed top or bottom surface. In FIG. 12, mold 400 is mounted on porous support 102. Mold 400 again is comprised of a first mold member 404 which defines at least one channel in the mold 400 in fluid communication with porous support 102. Second mold member 406 occupies the channel(s) defined in first mold member 404. In this embodiment, the surfaces 424 of first mold member 404 are substantially vertical and the walls 426 of second mold member 406 are angularly displaced from vertical.

In this embodiment, unlike the previously disclosed embodiments, first mold member 404 and second mold member 406 are made of different materials. Here, first mold member 404 is made of a much harder material than the elastomeric material used to make second mold member 406. This harder material may be elastomeric, with a higher durometer rating, or may be another type of material, such as metal.

As seen in FIG. 12, the softer second mold member 406 will have upper surfaces which are higher than the upper surface of the first mold member 404. After the mixture 108 of fiber 110 and fluid carrier 112 has been poured onto spaces between the mold 400, a pressure differential is again created across the mold 400, for example by air control device 116.

As seen in FIG. 13, press 118 is applied to the top of mold 400 and the bottom of porous support 102. In this embodiment, however, only the second mold member 406 is deformed to a substantial degree. Therefore, significant compressive forces are not applied by the surfaces 424 of the first mold member 404. Instead, such forces are applied only by the walls 426 of the deformed second mold member 406. However, the compressive forces applied normal to the object 420 still apply pressure to the surfaces 424 of the first mold member 404.

As seen in FIG. 14, the honey comb-like rib three-dimensional object 420 thus formed has outside dimensions substantially equal to the first mold member 404. This embodiment permits fabrication of three-dimensional objects of a honey comb-like structure having specific outside dimension limitations. However, the internal edges of object 420 have flanges 428 to enhance the object's strength for various applications.

Figure 15:
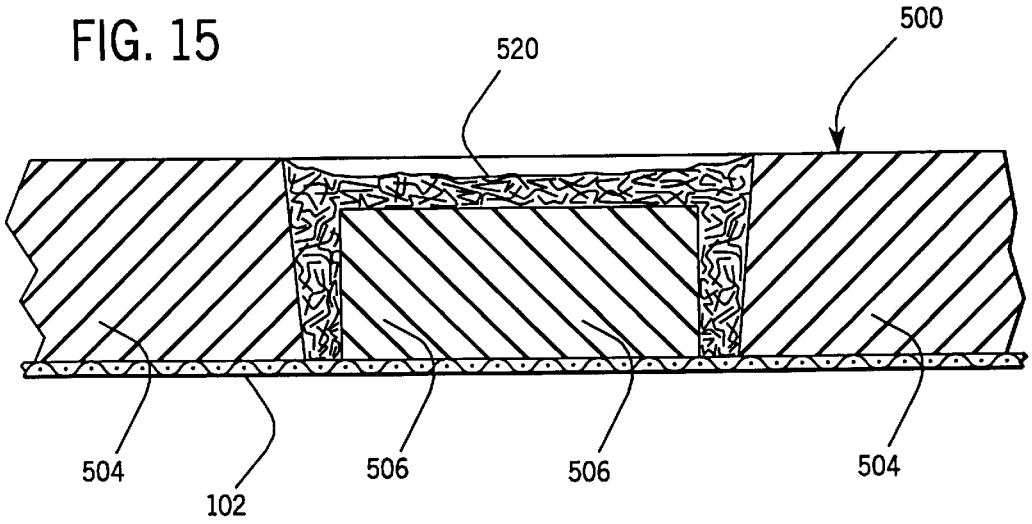
FIG. 15 is a cross-sectional view of a fifth embodiment of the invention depicting fibers deposited in the recessed parts of the mold formed around the second mold members, after application of a pressure differential across the mold and porous support.
Figure 16:
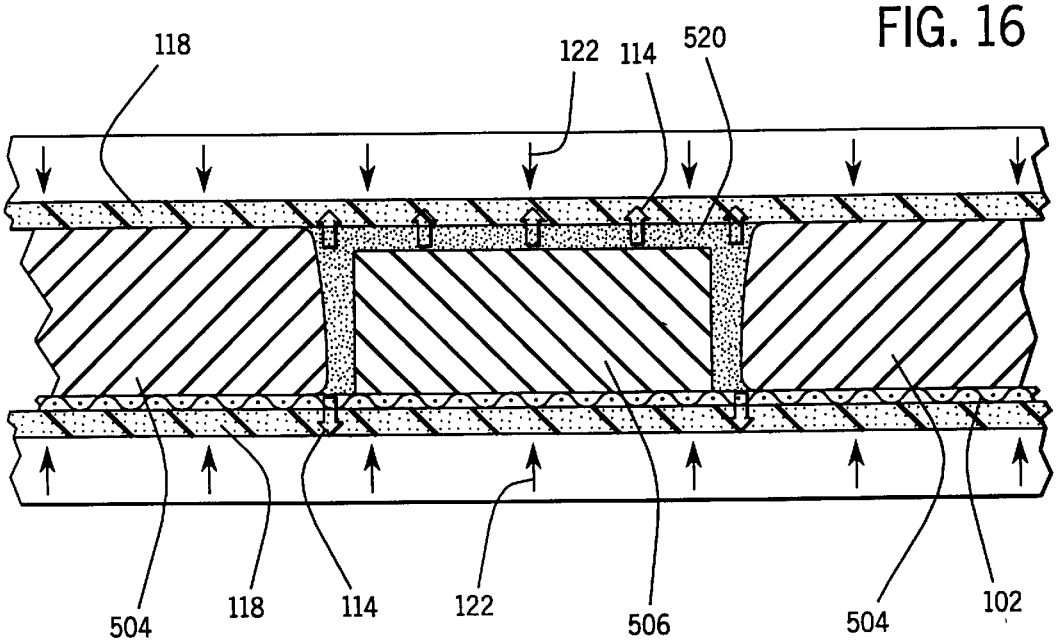
FIG. 16 is a cross-sectional view of the embodiment of FIG. 15 depicting compression of the mold and second mold members by a press and the resulting consolidation of the fibers.
Figure 17:
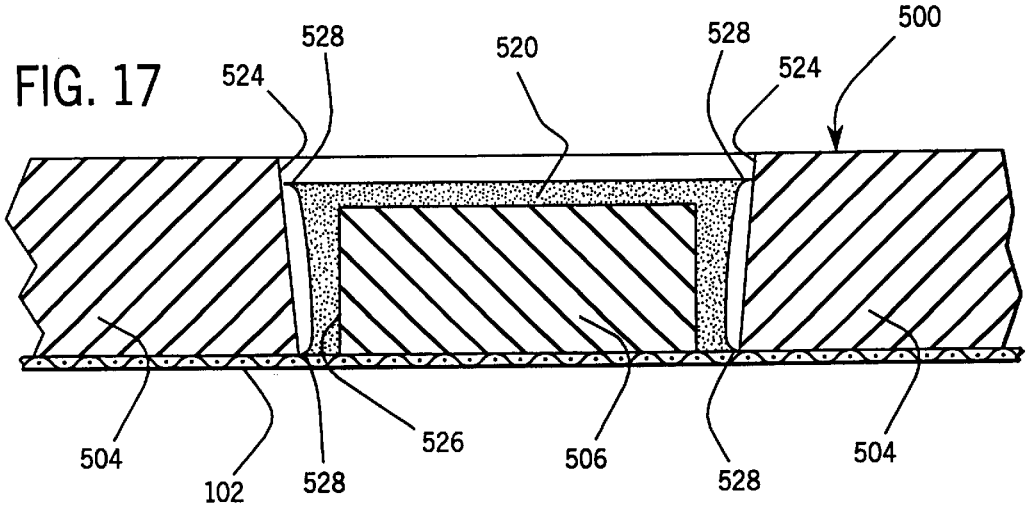
FIG. 17 is a cross-sectional view of the embodiment of FIG. 15 depicting the consolidated formed fiber object in the mold of the invention.

A fifth embodiment of the present invention is shown in FIGS. 15–17, which illustrate processing steps similar to those shown in FIGS. 3–5, with ribs and integrally-molded top surface. In FIG. 15, mold 500 is mounted on porous support 102. Mold 500 again is comprised of a first mold member 504 which defines at least one channel in the mold 500 in fluid communication with porous support 102. Second mold member 506 occupies the channel defined in first mold member 504. In this embodiment, the surfaces 524 of first mold member 504 are angularly displaced from vertical and the walls 526 of second mold member 506 are substantially vertical.

In this embodiment, first mold member 504 and second mold member 506 are also made of different materials. Here, however, second mold member 506 is made of a much harder material than the elastomeric material used to make first mold member 504. This harder material also may be elastomeric or may be another type of material, such as metal.

As seen in FIG. 15, the softer first mold member 504 has an upper surface which is higher than the upper surfaces of the second mold member 506. After the mixture 108 of fiber 110 and fluid carrier 112 is poured onto the mold 500, a pressure differential is again created across the mold 500, for example by air control device 116.

As seen in FIG. 16, press 118 is applied to the top of mold 500 and the bottom of porous support 102. In this embodiment, however, only the first mold member 504 is deformed. Therefore, compressive forces are not applied by the walls 526 of the second mold member 506. Instead, such forces are applied only by the surfaces 524 of the deformed first mold member 504. However, compressive forces are generated by deformation of the surfaces 524 of first mold member 504. These forces are applied normal to the object 520, and therefore apply pressure to the surfaces 524 of the first mold member 504 via the object 520.

As seen in FIG. 17, the three-dimensional object 520 formed has final internal dimensions substantially equal to the second mold member 506. This embodiment permits fabrication of objects having specific inside dimension limitations. However, the outside edges of object 520 have ribs with flanges 528 to enhance strength for various applications.

Figure 18:
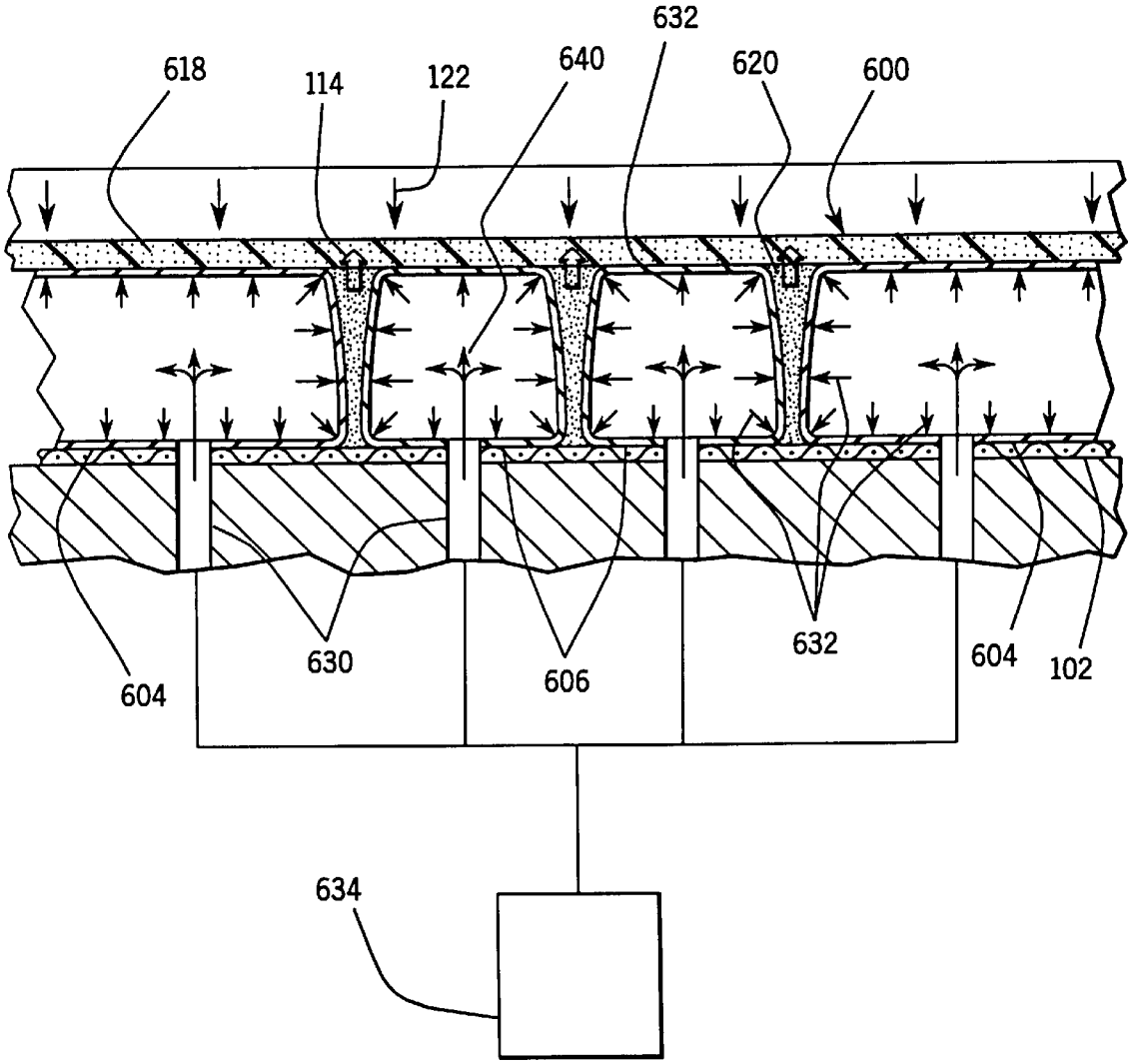
FIG. 18 is a cross-sectional view of a sixth embodiment of the invention showing compression of fibers and the inflated mold of the present invention by a press.

A sixth embodiment of the present invention is shown in FIG. 18, which illustrates a processing step similar to that shown in FIG. 4. In FIG. 18, mold 600 is mounted on porous support 102. Mold 600 again is comprised of a first mold member 604 which defines at least one channel in the mold 600 in fluid communication with porous support 102. Second mold member 606 occupies the channel defined in first mold member 604. In this embodiment, both the first mold member 604 and second mold member 606 are thin walled, inflatable structures connected by passages 630 to a source 634 of pressurizing fluid, such as air. Pressurizing fluid inflates each member 604, 606 of the mold 600, causing the members 604, 606 to deform generally in the directions of arrows 632. Further pressure is applied to the object 620 being formed by press 618 applied to the top of mold 600.

It will also be appreciated that the separate members 604, 606 of the mold 600 can be individually and separately inflatable, and thereby provide the differential deformability aspects of the invention depicted in various other embodiments.

Figure 19A:
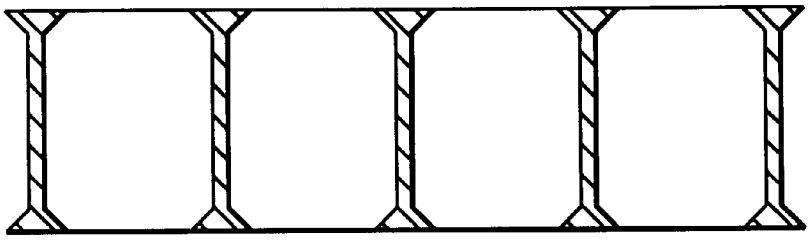
FIG. 19A is a crosssectional view and FIG. 19B is a perspective view depicting the consolidated formed fiber object of the invention consisting of ribs without integral stressed skins covering the ribs.
Figure 19B:
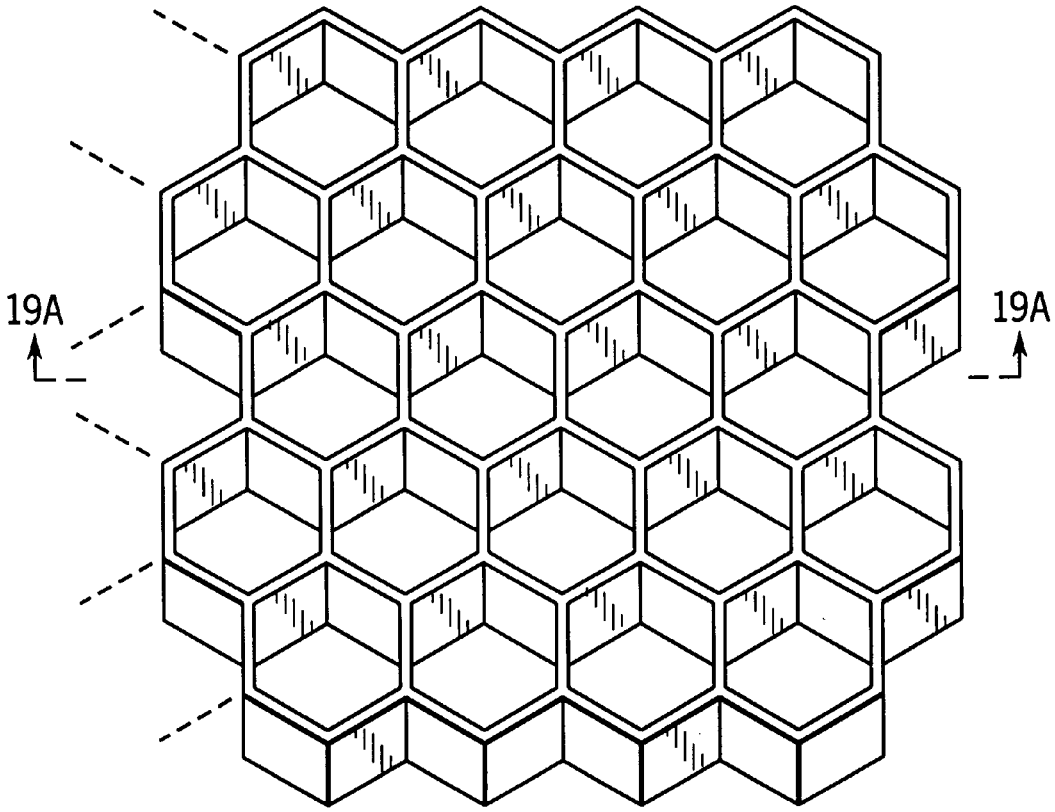

As seen in FIG. 19, the invention also provides three-dimensional object 220 which comprises a honey comb-like object consisting of a series of interconnected ribs with flanges, but without the top or bottom faces which characterize the molded objects heretofore molded in accordance with the prior art. These objects and their flanges can be specially shaped depending upon the desired application or use, and will provide a much stronger honey comb-like structure than any comparable honey comb-like structure heretofore known in the prior art.

Thus it can be seen that the present invention provides method and apparatus for forming three-dimensional objects having ribs with flanges made from fibers which provides a variety of structural features which enhance the strength and versatility of the objects. In addition, both the internal and external dimensions of the objects can be rigidly controlled by selecting the appropriate materials for construction of the various components of the present molds.

All patents and patent applications cited in this specification are hereby incorporated by reference as if they had been specifically and individually indicated to be incorporated by reference.

Although the foregoing invention has been described in some detail by way of illustration and example for purposes of clarity and understanding, it will be apparent to those of ordinary skill in the art in light of the disclosure that certain changes and modifications may be made thereto without departing from the spirit or scope of the appended claims.

What is claimed is:

1. An apparatus for making a plurality of independent three-dimensional objects from fibers comprising:

a) a porous support;

b) a first mold mounted on said porous support, said first mold comprising:

i) a first mold member composed of a first material and having an upper surface, said first mold member defining a plurality of channels permitting fluid communication between said first mold member upper surface and said porous support, wherein said first mold member upper surface is at a preselected height above said porous support; and ii) at least one second mold member composed of a second material, each of said second mold members occupying one of the channels in said first mold member and comprising a structure having a second mold member upper surface; and c) a press for compressing and deforming said first mold to form a three-dimensional object from each channel.

2. The apparatus of claim 1 wherein the press comprises of a means for drying the three-dimensional object on said first mold.

3. The apparatus of claim 1 further comprising:

d) a second mold for compressing, de forming, and drying the three-dimensional object created on said first mold.

4. The apparatus of claim 3 wherein said second mold includes at least one mold member having dimensions which are closer to the final dimensions of the dried three dimensional object than the dimensions of the first mold.

5. The apparatus of claim 1 wherein said first material is a first elastomeric material and said second material is a second elastomeric material.

6. The apparatus of claim 5 wherein said first elastomeric material is less resilient than said second elastomeric material.

7. The apparatus of claim 6 wherein said first mold member upper surface is higher than said second mold member upper surface.

8. The apparatus of claim 5 wherein said second elastomeric material is less resilient than said first elastomeric material.

9. The apparatus of claim 8 wherein said second mold member upper surface is higher than said first mold member upper surface.

10. The apparatus of claim 1 wherein said second mold member upper surface is at a different height above said first porous support than the height of said first mold member upper surface.

11. The apparatus of claim 10 wherein said first mold member upper surface is above said second mold member upper surface.

12. The apparatus of claim 10 wherein said first mold member upper surface is below said second mold member upper surface.

13. The apparatus of claim 1 wherein said first material is the same as said second material.

14. The apparatus of claim 1 wherein said mold members are inflatable structures which deform in response to changes in pressure.

15. An apparatus for making a plurality of independent three-dimensional objects from fibers comprising:

a) a porous support;

b) a first mold mounted on said porous support, said first mold comprising:

i) a first mold member composed of a first material and having an upper surface, said first mold member defining a plurality of channels permitting fluid communication between said first mold member upper surface and said porous support, wherein said first mold member upper surface is at a preselected height above said porous support; and ii) at least one second mold member composed of a second material, each of said second mold members occupying one of the channels in said first mold member and comprising a structure having a second mold member upper surface;

c) a fiber directing device that directs fibers from the upper surface of the first mold member and into the channels; and d) a press for compressing and deforming said first mold to form a three-dimensional object from each channel.

16. The apparatus of claim 15 wherein the press comprises of a means for drying the three-dimensional object on said first mold.

17. The apparatus of claim 15 further comprising:

e) a second mold for compressing, deforming, and drying the three-dimensional object created on said first mold.

18. The apparatus of claim 17 wherein said second mold includes at least one mold member having dimensions which are closer to the final dimensions of the dried three dimensional object than the dimensions of the first mold.

19. The apparatus of claim 15 wherein said first material is a first elastomeric material and said second material is a second elastomeric material.

20. The apparatus of claim 19 wherein said first elastomeric material is less resilient than said second elastomeric material.

21. The apparatus of claim 20 wherein said first mold member upper surface is higher than said second mold member upper surface.

22. The apparatus of claim 19 wherein said second elastomeric material is less resilient than said first clastomeric material.

23. The apparatus of claim 22 wherein said second mold member upper surface is higher than said first mold member tipper surface.

24. The apparatus of claim 15 wherein said second mold member upper surface is at a different height above said porous support than the height of said first mold member upper surface.

25. The apparatus of claim 24 wherein said first mold member upper surface is above said, second mold member upper surface.

26. The apparatus of claim 24 wherein said first mold member upper surface is below said second mold member upper surface.

27. The apparatus of claim 15 wherein said first material is the same as said second material.

28. The apparatus of claim 15 wherein said mold members are inflatable structures which deform in response to changes in pressure.

29. An apparatus for making a plurality of independent three-dimensional objects from fibers comprising:

a) a porous support;

b) a first mold mounted on said porous support, said first mold comprising:

i) a first mold member composed of a first elastomeric material and having an upper surface, said first mold member defining a plurality of channels permitting fluid communication between said first mold member upper surface and said porous support, wherein said first mold member upper surface is at a preselected height above said porous support; and ii) at least one second mold member composed of a second elastomeric material, each of said second mold members occupying one of the channels in said first mold member and comprising a structure having a second mold member upper surface, wherein said second elastomeric material is more resilient than said first elastomeric material; and c) a means for compressing and deforming said first mold to form a three-dimensional object from each channel.

30. The apparatus of claim 29 wherein said first mold member upper surface is higher than said second mold member upper surface.

31. An apparatus for making a plurality of independent three-dimensional objects from fibers comprising:

a) a porous support;

b) a first mold mounted on said porous support, said first mold comprising:

i) a first mold member composed of a first elastomeric material and having an upper surface, said first mold member defining a plurality of channels permitting fluid communication between said first mold member upper surface and said porous support, wherein said first mold member upper surface is at a preselected height above said porous support; and ii) at least one second mold member composed of a second elastomeric material, each of said second mold members occupying one of the channels in said first mold member and comprising a structure having a second mold member upper surface, wherein said second elastomeric material is less resilient than said first elastomeric material; and c) a means for compressing and deforming said first mold to form a three-dimensional object from each channel.

32. The apparatus of claim 31 wherein said second mold member upper surface is higher than said first mold member upper surface.

33. An apparatus for making a plurality of independent three-dimensional objects from fibers comprising:

a) a porous support;

b) a first mold mounted on said porous support, said first mold comprising:

i) a first mold member composed of a first material and having an upper surface, said first mold member defining a plurality of channels permitting fluid communication between said first mold member upper surface and said porous support, wherein said first mold member upper surface is at a preselected height above said porous support; and ii) at least one second mold member composed of a second material, each of said second mold members occupying one of the channels in said first mold member and comprising a structure having a second mold member upper surface, wherein said second mold member upper surface is at a different height above said first porous support than the height of said first mold member upper surface; and c) a means for compressing and deforming said first mold to form a three-dimensional demensional object from each channel.

34. The apparatus of claim 33 wherein said first mold member upper surface is above said second mold member upper surface.

35. The apparatus of claim 33 wherein said first mold member upper surface is below said second mold member upper surface.

36. An apparatus for making a plurality of independent three-dimensional objects from fibers comprising:

a) a porous support;

b) a first mold mounted on said porous support, said first mold comprising:

i) a first mold member composed of a first elastomeric material and having an upper surface, said first mold member defining a plurality of channels permitting fluid communication between said first mold member upper surface and said porous support, wherein said first mold member upper surface is at a preselected height above said porous support; and ii) at least one second mold member composed of a second elastomeric material, each of said second mold members occupying one of the channels in said first mold member and comprising a structure having a second mold member upper surface, wherein said second elastomeric material is more resilient than said first elastomeric material; and c) a fiber directing device that directs fibers from the upper surface of the first mold member and into the channels; and d) a means for compressing and deforming said first mold to form a three-dimensional object from each channel.

37. The apparatus of claim 36 wherein said first mold member upper surface is higher than said second mold member upper surface.

38. An apparatus for making a plurality of independent three-dimensional objects from fibers comprising:

a) a porous support;

b) a first mold mounted on said porous support, said first mold comprising:

i) a first mold member composed of a first elastomeric material and having an upper surface, said first mold member defining a plurality of channels permitting fluid communication between said first mold member upper surface and said porous support, wherein said first mold member upper surface is at a preselected height above said porous support; and ii) at least one second mold member composed of a second elastomeric material, each of said second mold members occupying one of the channels in said first mold member and comprising a structure having a second mold member upper surface, wherein said second elastomeric material is less resilient than said first elastomeric material; and c) a fiber directing device that directs fibers from the upper surface of the first mold member and into the channels; and d) a means for compressing and deforming said first mold to form a three-dimensional object from each channel.

39. The apparatus of claim 38 wherein said second mold member upper surface is higher than said first mold member upper surface.

40. An apparatus for making a plurality of independent three-dimensional objects from fibers comprising:

a) a porous support;

b) a first mold mounted on said porous support, said first mold comprising:

i) a first mold member composed of a first material and having an upper surface, said first mold member defining a plurality of channels permitting fluid communication between said first mold member upper surface and said porous support, wherein said first mold member upper surface is at a preselected height above said porous support; and ii) at least one second mold member composed of a second material, each of said second mold members occupying one of the channels in said first mold member and comprising a structure having a second mold member upper surface, wherein said second mold member upper surface is at a different height above said first porous support than the height of said first mold member upper surface; and c) a fiber directing device that directs fibers from the upper surface of the first mold member and into the channels; and d) a means for compressing and deforming said first mold to form a three-dimensional object from each channel.

41. The apparatus of claim 40 wherein said first mold member upper surface is above said second mold member upper surface.

42. The apparatus of claim 40 wherein said first mold member upper surface is below said second mold member upper surface.

* * * * *